US005505342A

United States Patent [19]

Okamura et al.

[11] Patent Number: 5,505,342

[45] Date of Patent: Apr. 9, 1996

[54] COMPOSITE CONTAINER FOR LOW VISCOSITY LIQUIDS AND A METHOD OF MANUFACTURING THE SAME

[75] Inventors: Naomi Okamura, Saitama; Takao Hino, Yokohama; Akio Nimura, Saitama; Masayuki Fukai; Shozo Goda, both of Tokyo; Keizi Shimizu, Kobe; Harumi Moriuchi; Chiaki Hata, both of Osaka, all of Japan

[73] Assignees: Taoka Chemical Company, Ltd., Osaka; Cemedine Company, Ltd., Tokyo, both of Japan

[21] Appl. No.: 357,992

[22] Filed: Dec. 16, 1994

Related U.S. Application Data

[63] Continuation of Ser. No. 47,483, Apr. 19, 1993, abandoned.

[30] Foreign Application Priority Data

| | | | |
|---|---|---|---|
| Jul. 3, 1992 | [JP] | Japan | 4-198963 |
| Dec. 28, 1992 | [JP] | Japan | 4-348251 |
| Dec. 28, 1992 | [JP] | Japan | 4-348252 |
| Dec. 28, 1992 | [JP] | Japan | 4-348253 |

[51] Int. Cl.[6] ..... B65D 37/00

[52] U.S. Cl. ..... 222/212; 222/131; 222/105; 222/214

[58] Field of Search ..... 222/131, 94, 210, 222/212, 214, 105, 106, 108, 153.04, 562, 567, 570, 571

[56] References Cited

U.S. PATENT DOCUMENTS

| | | | |
|---|---|---|---|
| 3,231,156 | 1/1966 | Schultz | 222/570 X |
| 3,704,819 | 12/1972 | Lindstrom | 222/570 X |
| 4,047,642 | 9/1977 | Nilson | 222/131 X |
| 4,585,149 | 4/1986 | Zulauf | 222/94 |
| 4,752,020 | 6/1988 | Grueter et al. | 222/182 X |
| 4,867,593 | 9/1989 | Kurokawa et al. | 222/212 X |
| 4,940,167 | 7/1990 | Fillmore et al. | 222/153 |
| 5,094,363 | 3/1992 | Monahan et al. | 222/131 |
| 5,111,949 | 5/1992 | Ambrosi et al. | 222/153 X |
| 5,152,427 | 10/1992 | Pope et al. | 222/106 |
| 5,388,727 | 2/1995 | Jouillat | 222/94 |

FOREIGN PATENT DOCUMENTS

| | | | |
|---|---|---|---|
| 0123164 | 3/1984 | European Pat. Off. . | |
| 1497051 | 8/1967 | France | 222/562 |
| 58-8682 | 7/1983 | Japan . | |
| 62-44914 | 2/1987 | Japan . | |
| 204207 | 4/1939 | Switzerland | 222/571 |
| 698418 | 10/1953 | United Kingdom | 222/214 |
| 959808 | 6/1964 | United Kingdom | 222/570 |
| 2181105 | 4/1987 | United Kingdom | 222/214 |

*Primary Examiner*—Andres Kashnikow
*Assistant Examiner*—Lisa Douglas

[57] ABSTRACT

A composite container for low viscosity liquids, capable of discharging the contents completely, without producing dripping of liquids after discharging adhesives, medicines, foods, ink and other low viscosity liquids. The container includes an inner container which contains the contents and includes an opening for discharging the contents, and an outer casing container covering the inner container body. A pressure medium is interposed between the inner container body and the outer casing container.

23 Claims, 13 Drawing Sheets

COMPOSITE CONTAINER FOR LOW VISCOSITY LIQUIDS AND A METHOD OF MANUFACTURING THE SAME

This application is a continuation, of application Ser. No. 08/047,483 filed on Apr. 19, 1993, now abandoned.

BACKGROUND OF THE INVENTION

The present invention relates to a novel composite container for low viscosity liquids, in which dripping of liquids does not occur after discharging adhesives, medicines, foods, ink and other low viscosity liquids, even a small amount of contents can be easily handled and the contents can be discharged completely.

Though different types such as a volatile solvent type and a moisture curing type are included in liquid adhesives which are the typical low viscosity liquids, in the case of volatile solvent type adhesives a plastic tube can not be used, and in the case of moisture curing type adhesives the plastic tube which is not moistureproof can not be used. And hence, metal tubes such as an aluminum tube and a lead tube are used for these types of adhesives.

However, since the metal tube has no restoring force, a so-called dripping of liquids occurs after discharging the contents or the adhesives. For example, when the contents has a low viscosity such as instantaneous adhesive, this phenomenon is more remarkable. Also, since the metal tube has no restoring force, it collapses as used and becomes difficult to use, besides deforms externally and shows a poor appearance. Furthermore, the metal tube can not be placed vertically, and a cap must be closed each time to prevent the contents from flowing out when laying down during use, which is troublesome. In addition, when the amount of contents is little, the metal tube is small and inconvenient to use.

In order to solve these problems, as disclosed in, for example, the Japanese Published Examined Utility Model Publications (Jikko) Sho 58-8682 and Sho 62-44914, it is proposed to cover the outer surface of the metal tube with a cylindrical plastic tube or a tubular plastic.

However, since this type is to restore the metal tube by a restoring force of the plastic tube or the tubular plastic, and thereby suck in effluents accumulated at an opening, the following force against the metal tube is insufficient and a suction force to suck the effluents is weak. Particularly, the restoring force becomes weaker as used, and the object can not be attained sufficiently.

In order to solve the above-mentioned problems, as a result of research, the inventors have found that, a so-called restoring force can be further enhanced by an idea which is entirely different from the prior art, that is, by a composite container between which a pressure medium is interposed, thereby a composite container for low viscosity liquids, in which dripping of liquids after discharging the low viscosity adhesives is prevented, even a small amount of contents is easy to handle, the contents can be used completely, a shape of the entire container can be kept until the contents are all used, and furthermore, the container can be placed vertically, was accomplished.

SUMMARY OF THE INVENTION

First Invention (Basic Invention)

The present invention is directed to a composite container for low viscosity liquids comprising, an inner container containing the contents and including an opening for discharging the contents, and an outer casing container covering a body of the inner container, a pressure medium being interposed between the inner container and the outer casing container.

By combining the containers and interposing the pressure medium therebetween, a so-called restoring force is further enhanced, and the dripping of liquids after discharging low viscosity adhesives and the like is prevented.

Second Invention (Forming Latchet Teeth)

The present invention is directed to a composite container for low viscosity liquids, in which an inner container containing the contents and including an opening is covered by an outer casing container. A nozzle having a discharge path is screwed onto the opening of the inner container and a cap which closes the discharge path of the nozzle and mates with the nozzle is provided. The composite container for low viscosity liquids is characterized, in that a pressure medium is interposed between the inner container and the outer casing container, in that a base end portion of the opening of the inner container is inserted into the outer casing container, in that a boss formed with latchet teeth on an outer surface thereof is provided, and in that inner latchet teeth which mate with the latchet teeth are disposed on the nozzle.

The present invention is a preferred embodying mode of the above-mentioned basic invention and relates to connections between the inner container, outer casing container and nozzle, and it is an object thereof to prevent the nozzle from rotating together when unscrewing the cap, by mating the latchet teeth.

Third Invention (Forming of Positioning Groove and Protrusions)

The present invention is directed to a composite container for low viscosity liquids, in which an outer casing container covering an inner container body containing the contents and including an opening is constituted by a tubular main member and a bottom member. A pressure medium is interposed between the inner container and the outer casing container. A bottom wall which closes a bottom opening of the main member and spacers which are raised from the bottom wall and inserted into a bottom of the main member are disposed on the bottom member. A positioning groove into which the inner container bottom is inserted for positioning is formed at the center of the spacers, and positioning protrusions which advance into the positioning groove for positioning are protruded on the main member.

The present invention corresponds to one embodying mode of the aforementioned basic invention, in which by dividing the outer casing container into the tubular main member covering the inner container body and the bottom member which closes the bottom opening of the main member, the main member can be formed relatively soft to improve the handiness. By forming the positioning protrusions and the positioning groove, the inner container bottom is positioned at the center by just inserting the bottom member into the main member bottom. Thereby, assembling operability is enhanced and the contents can be squeezed out completely.

Fourth Invention (Forming of Ribs for Preventing Dripping of Liquids)

The present invention is directed to a composite container for low viscosity liquids, in which an inner container containing the contents and including an opening is covered by an outer casing container. A nozzle having a discharge path is mounted on the opening of the inner container, and a cap covering the nozzle is included. The composite container for low viscosity liquids is characterized, in that a pressure medium is interposed between the inner container and the outer casing container, and in that ribs for preventing dripping of liquids are formed on an inner surface of a portion above a mounting portion of a cap to the nozzle.

The present invention corresponds to one embodying mode of the aforementioned basic invention, and it is an object thereof to prevent effluents from dripping, solidifying and bonding the cap to the nozzle to disable the caps removal.

Fifth Invention (A Method of Manufacturing a Composite Container)

The present Invention is directed to a method of manufacturing a composite container for low viscosity liquids comprising, an inner container containing the contents and including an opening for discharging the contents, and an outer casing container covering the inner container body, and interposing a pressure medium between the inner container and the outer casing container. The method of manufacturing the composite container for low viscosity liquids is characterized by pouring one kind or two or more kinds of curable liquid resin compositions as the pressure medium, when necessary, in a closed state.

The present invention is one preferred embodying mode of a method of manufacturing a composite container for low viscosity liquids of the basic invention. The curable liquid resin compositions such as urethane and the like are poured in as the pressure medium, and cured. An elastic material is then obtained such as urethane elastomer.

First Invention (Basic Invention)

In the following, a configuration and a using mode of a first invention (basic invention) are described based on the drawings.

Figure 1:
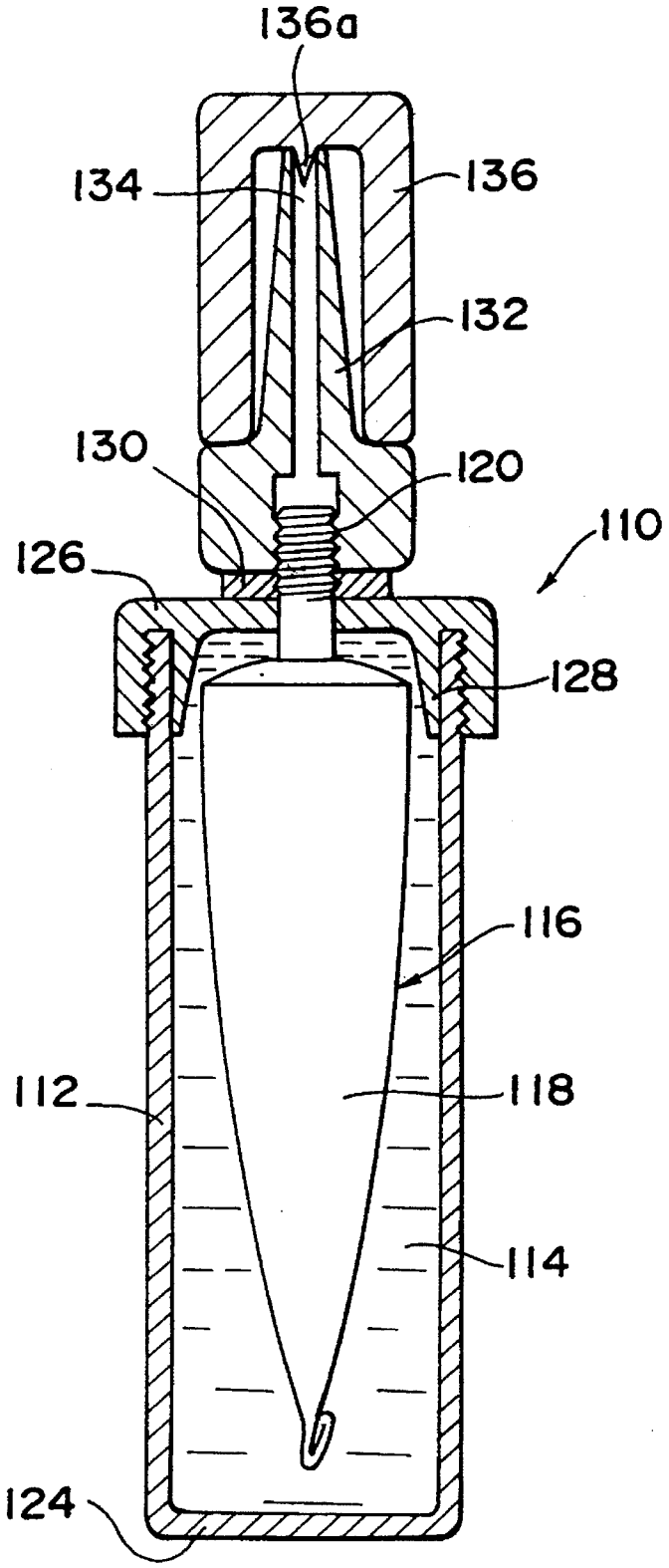
FIG. 1 is a schematic sectional view of a composite container showing one embodiment according to the present invention.

FIG. 1 is a schematic sectional view of a composite container for low viscosity liquids showing one embodiment of the present invention, wherein numeral 116 designates an inner container made of, for example, an aluminum tube, numeral 120 designates an opening for discharging contents, numeral 132 designates a nozzle, numeral 136 designates a cap for closing the nozzle, numeral 112 designates an outer casing container (e.g. an elastic synthetic resin) covering a body of the inner container 116, numeral 114 designates a pressure medium composed of, for example, rubber-like elastic materials and numeral 126 designates a cap of the outer casing container 112 for keeping a closed state.

When describing the using state of the composite container of the present invention in the case of instantaneous adhesives, by removing the closing cap 136 and pressing the outer casing container 112 by the hands, for example, a center portion 118 of the inner container 116 is pressed via the pressure medium 114, and the instantaneous adhesive in the inner container 116 is discharged from the opening 120 through a nozzle end 134.

Next, when pressure applied to the outer casing container 112 is released, the inner container 116 tends to restore to the original shape due to a restoring force by an interaction of the pressure medium 114 and the outer casing container 112, thus dripping of the contents is prevented by the suction.

As mentioned above, in the present invention, the inner container 116 including the opening 120 is made from various materials such as synthetic resins, metals and the like which are inactive and not permeable against the contents. For example, in the case of instantaneous adhesives such as α-cyanoacrylate, usually, a metal tube of aluminum or lead or a laminated tube of metal and synthetic resin or a polyethylene tube are preferably used. The metal tube is suitable for keeping the moisture hardening type or volatile solvent type contents in the closed state.

In the present invenion, the outer casing container 112, covering the inner container 116, serves to hold the pressure medium 114 of the present invention around the inner container 116, transfers the external biasing force to the inner container 116, requires an elastic function to discharge the contents, and further, is preferably made of the material such as elastic resins having a restoring force, thus, though, usually, polyethylene group, polypropylene group, polyester group, polyamide group and vinyl chloride group synthetic resins or laminated tubes are used, particularly, polybutadiene group resins having a good restoring force are preferably used.

The outer casing container can have various shapes such as a cylinder, polygon such as triangle, quadrangle, triangular pyramid, sectional ellipse or their combinations, and other various shapes of lighters and cosmetics are applied. The bottom or cap may be formed planarly so that the composite container can be placed vertically or upside down, thus any modification can be made.

In the present invention, the pressure medium 114 is a medium for transferring pressure applied to the outer casing container to the inner container. Fluidized materials such as a liquid and high viscosity liquids, and semisolid or solid materials such as gels, foamed materials, sealing agents, rubber-like elastic materials and the like are used as the pressure medium. When the pressure medium is composed of the fluidized materials, in order to attain the object of the present invention effectively, the outer casing container needs to be kept in a predetermined closed state. The closed state is not always required when the solid foamed materials and sealing agents or the solid elastics such as the rubber-like elastic materials are used.

However, we have found that, in order to enhance the function of the pressure medium, it is more preferable to interpose the pressure medium between the inner container and the outer casing container in the closed state. That is, by keeping the closed state, the biasing force from the outside can be transferred smoothly. In this case, we have also found that, in the present invention, though the fluidized liquids and rubber-like elastic materials are used as the pressure medium, they need not be independent. Various mixtures such as gas and liquid, gas and solid, liquid and solid may by applied, and the mixtures are sometimes more preferable.

Included in these mixtures, examples of gasses used as the pressure medium of the present invention, are air or inert gas such as nitrogen. Examples of fluidized liquids include water, oil and the like, high viscosity greasy or puddingy materials. Specifically, polyethylene glycol, silicon oil, paraffin and the like are given. In addition, high viscosity liquids, liquid rubbers (liquid BR, liquid SBR, liquid NBR), liquid polybutadiene, liquid polychloroprene, liquid polysulfide, liquid polyisoprene, liquid butyl rubber and other various high viscosity liquid materials are used.

Examples of gels used as the pressure medium used in the present invention include, gelatin, low molecular weight polyethylene, paste and the like. Also, as the sealing agents, single-liquid silicon, single-liquid urethane resin and the like are given.

As elastic materials preferably used in the present invention, various natural rubbers or synthetic rubbers, resin foamed materials and the like are given, and specifically, the synthetic rubbers (BR, SBR, IR, EPDM etc.), urethane rubber, silicon rubber, acryl rubber, styrene acryl rubber, polyether group rubber, propylene oxide rubber, various elastomers (styrene group thermoplastic elastomer, olefin group thermoplastic elastomer, urethane group thermoplastic elastomer, polyester group thermoplastic elastomer, polyamide group thermoplastic elastomer, polybutadiene group thermoplastic elastomer, vinyl chloride group thermoplastic elastomer, fluorine group thermoplastic elastomer), other foamed polyethylene, foamed polypropylene, other various elastic plastics, thermoplastic rubbers and various elastomers are used.

Besides, as the elastic materials preferably used in the present invention, the thermoplastic resins such as polyethylene, polypropylene, polyvinyl chloride, polystyrene, polyvinylidene chloride, fluorine resin, polymethyl methacrylate, polyamide such as nylon, polyester, polycarbonate, polyphenylene oxide, polyurethane, polyacetal and the like are given.

Furthermore, as the elastics (solid) preferably used in the present invention, ethylene-vinyl acetate copolymer group hot melt adhesives (hereinafter abbreviated as EVA group hot melt adhesives), thermoplastic rubber group hot melt adhesives, polyamide group hot melt adhesives (typically nylon), polyester group hot melt adhesives or thermoplastic hot melt adhesives are given.

In the present invention, though the rubber-like elastic materials which are preferably used can be used as the pressure medium as it is, practically, liquid compositions (one-liquid type or two-liquid type) which are precursors of the rubber-like elastic materials are poured between the inner container and the outer casing container in a liquid state, when necessary, covering the outer casing container 112 with the cap 126, and curing to manufacture a composite container for low viscosity liquids. This method is the most preferable mode for manufacturing the composite container for low viscosity liquids and is to be described later in detail.

Hereupon, the curing includes the methods of curing by chemical reactions and solidifying by the cooling and heating.

In the present invention, we have found that, since an adequate restoring force is obtained when the solid elastic materials such as the rubber-like materials and urethane foam having an adequate elasticity are used as the pressure medium as it is, it is more preferable to bond the pressure medium to the inner container and the outer casing container by means of adhesives and the like. We also found that, it is more preferable to interpose the pressure medium in the closed state, when the solid elastics such as the rubber-like materials and urethane foam having an adequate elasticity are used as it is. In such closed state, by cutting the solid elastics into adequate shapes or chopping into pieces before insertion, the adequate restoring force is produced and dripping of liquids can be prevented.

The composite container for low viscosity liquids of the present invention is manufactured advantageously, industrially and practically by the following method.

Fifth Invention (Method of Manufacturing the Composite Container)

In the following, a method of manufacturing the composite container of the present invention is described in detail. That is, for .example, in FIG. 1, the composite container for low viscosity liquids which is the object of the present invention and comprises, the inner container 116 (filled with the contents) including the opening 120 for discharging the contents and the cap body 136 for closing the opening, and the outer casing container 112 covering the inner container 116 is manufactured by, inserting the inner container 116 into the outer casing container 112 as shown in FIG. 1. Curable liquid resin compositions composed of one kind or two or more kinds are poured between the inner container 116 and the outer casing container 112 as the pressure medium 114, when necessary, closing the cap 126 of the outer casing container 112 to obtain the closed state, and curing the liquid resin compositions to obtain the rubber-like elastic materials.

This method of the present invention is advantageous in that, the composite container for low viscosity liquids which is the object of the present invention can be manufactured industrially very easily. That is, though the pressure medium of the present invention is preferably inserted tightly (without gaps) between the inner container and the outer casing container covering the same, according to the present invention, by pouring the manageable liquid resin compositions (and a curing agent) first between the inner container and the outer casing container, when necessary, closing the outer casing container with the cap to keep the closed state, the liquid resin compositions is cured into a solid rubber-like elastic materials after a predetermined time (usually, several minutes to several hours), therefore it is very convenient in keeping between the inner container and the outer casing container in the closed state.

Curing of the liquid resin compositions used in manufacturing the composite container for low viscosity liquids of the present invention is dependent on kinds and properties of the rubber-like elastic materials used. Though it is not, particularly restricted, there are, for example, a room temperature curing type, an ultraviolet ray curing type, a heat curing type, a moisture curing type or a hot melt type (this is a solid elastic which is liquified by heating and cooled after being poured in). Among these types the room temperature curing type is particularly preferable when considering effects on the contents. In the room temperature curing type, usually, compositions containing a main agent and a curing agent are used. It is to be understood that the mixed liquid resin compositions of one-liquid type or two-liquid type or more are used.

According to the manufacturing method of the above-mentioned present invention, the space between the inner container and the outer casing container can easily be made tightly and kept in closed state. Thus, the rubber-like elastic materials serve as a preferred transfer medium by pressure applied to the outer casing container to conveniently discharge the contents of the inner container. By keeping the closed state the restoring force of the rubber-like elastic materials is enhanced and a so-called high squeezing property is obtained. This results in the most preferable embodying mode of the present invention.

It was previously mentioned that, in the present invention, the pressure medium composed of such elastic resins preferably has an adhesiveness against the inner container and/or outer casing container from the viewpoint of improving the restoring force. This is dependent on the property of the respective containers and the kind and property of the rubber-like elastic material as the pressure medium. When necessary, though it is possible or sometimes preferable to add the adhesives, since the operation is generally complicated, it is most preferable to suitably select the pressure medium among the materials having the adhesiveness against the inner container and/or outer casing container by itself when selecting the materials of the inner container, outer casing container and pressure medium.

When the contents of the inner container is, for example, the two-part adhesives, it is convenient if two inner containers are contained in one outer casing container to obtain one container as a whole.

Furthermore, if the outer casing container is made larger as compared with the inner container, even if the inner container is for a small amount of contents, it is easy to handle and preferable.

In the following, a construction, embodying mode and its modification of the composite container for low viscosity container of the present invention are described more particularly with reference to the accompanying drawings.

FIG. 1 is a sectional view showing one embodiment of a composite container 110 according to the present invention, wherein the composite container 110 comprises an inner container 116 consisting of an opening 120 formed at one end thereof for discharging the contents, a nozzle 132 having a discharge opening in the periphery of a nozzle end 134, a cap 136 for closing the nozzle 132 and a protrusion **136*a* for closing the discharge opening, and an outer casing container 112, between the inner container 116 and the outer casing container 112, preferably a pressure medium 114** is interposed.

Numeral 128 designates a reinforcing piece for keeping the outer casing container 112 in shape. Numeral 130 designates a clamping nut for keeping a closing cap 126 of the outer casing container 112 tight.

Figure 2:
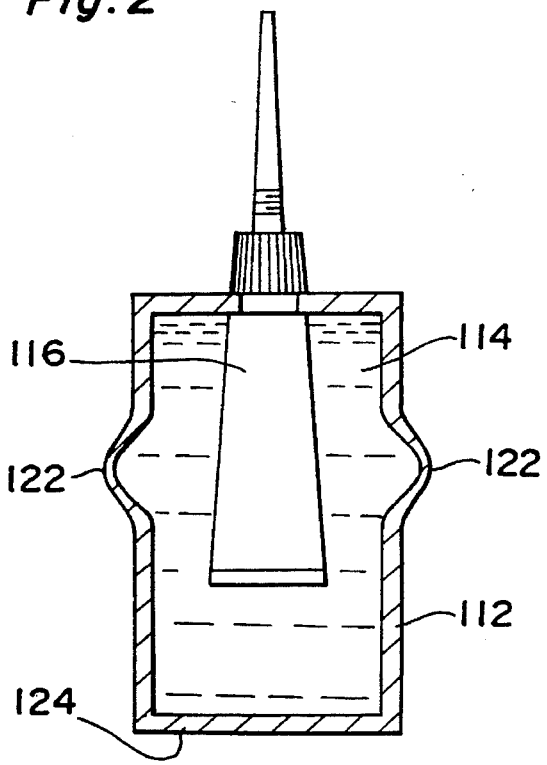
FIG. 2 is a schematic sectional view of a composite container showing another example of an outer casing container, which is made restorable by thinning a portion thereof.
Figure 3:
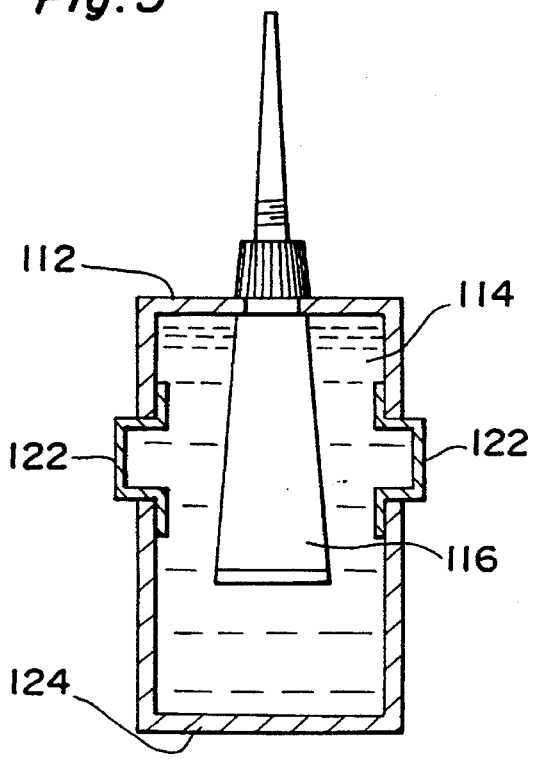
FIG. 3 is a schematic sectional view of a composite container showing still another example of an outer casing container, which is made restorable by forming a portion thereof with rubber.
Figure 5:
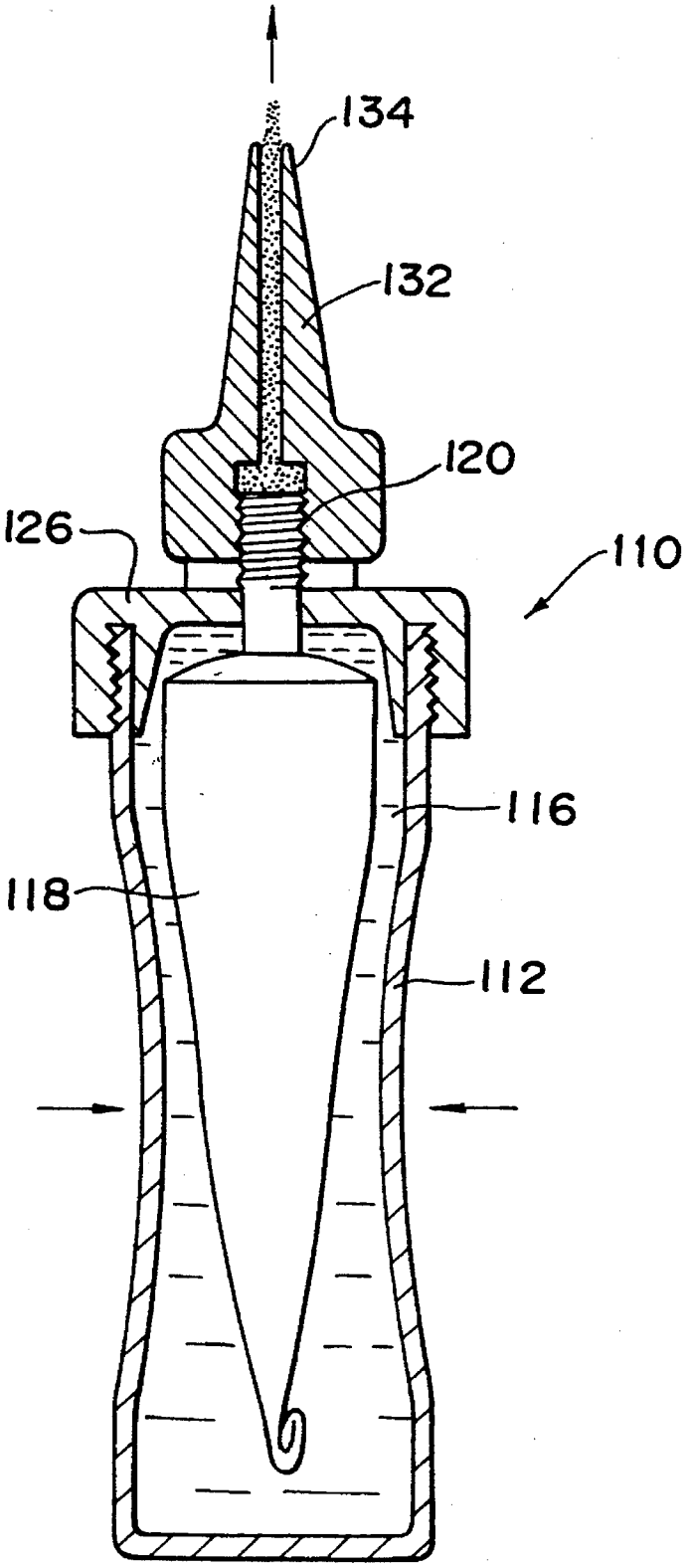
FIG. 5 is a schematic sectional view showing the operation of a composite container.

When practically using the composite container 110, by removing the cap 136 and pressing the outer casing container 112 as shown in FIG. 5, or pressing press portions 122 as shown in FIGS. 2 and 3, a center portion 118 of the inner container 116 is pressed via the pressure medium 114, and a low viscosity liquid which is the contents in the inner container 116 is discharged from the periphery of the nozzle end 134.

Next, when the pressure applied to the outer casing container 112 is released, by the outer casing container 112 or the press portions 122 which restore by the interaction via the pressure medium 114, the inner container 116 is also restored to cause pressure reduction therein, thereby air is sucked in from the nozzle end 134 and dripping of the contents is prevented. At this time, the shape of the inner container 116 is also restored to the original shape.

Figure 6:
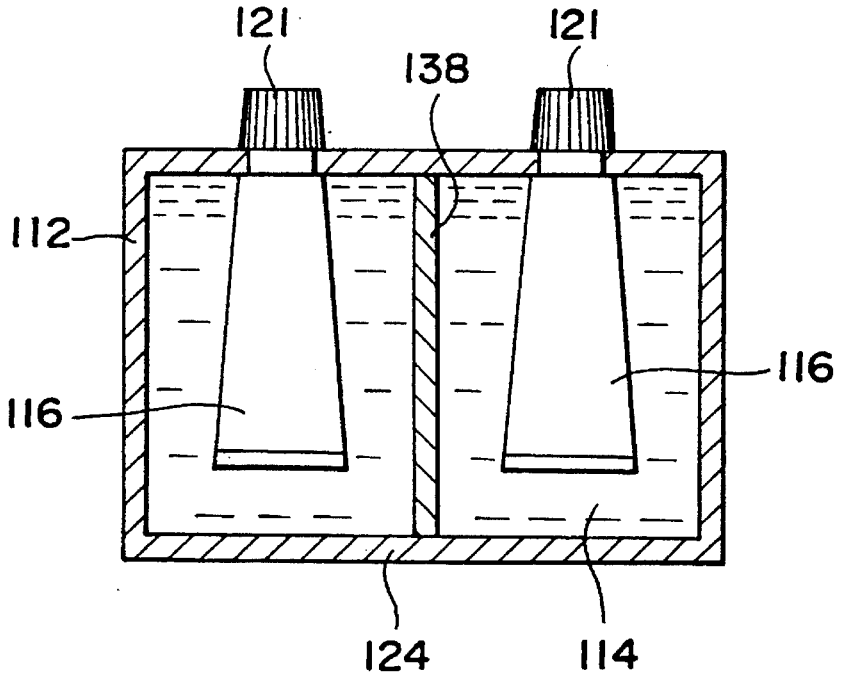
FIG. 6 is a schematic sectional view of a composite container showing the case of containing two-part adhesives.
Figure 7:
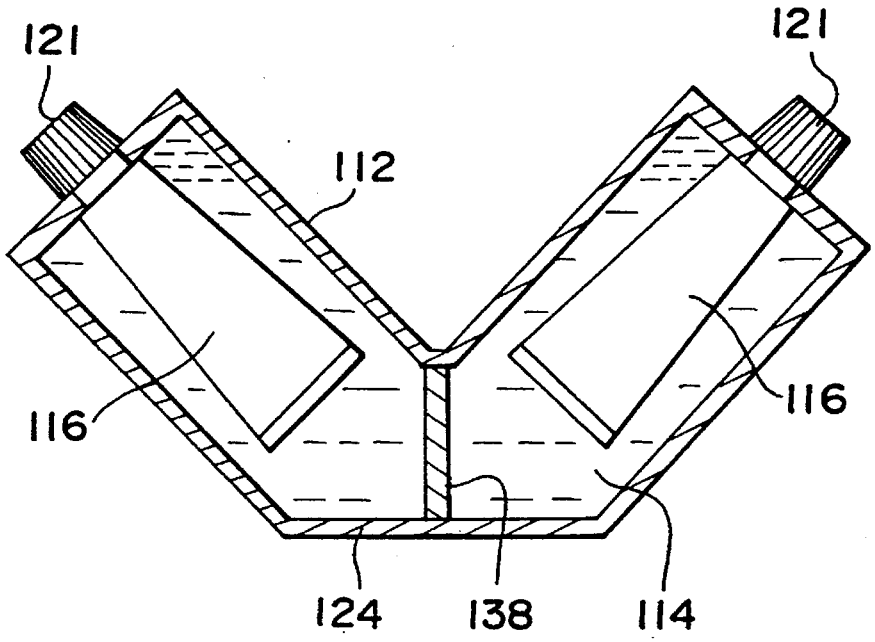
FIG. 7 is a schematic sectional view of a composite container showing another example of an outer casing container of FIG. 6.

FIG. 6 and FIG. 7 show other embodiments, for example, the composite containers for two-part adhesives are shown. Though various shapes can be considered, the inner container 116 may be formed vertically as shown in FIG. 6, or the inner containers 116 may be respectively inclined as shown in FIG. 7. In this case, the outer casing container 112 may be divided into two chambers by means of a portion 138 so that the two inner containers 116 can be discharged independently, in this case the pressure medium 114 in respective chambers is isolated. In case of the shape shown in FIG. 7, even when the partition 138 is not provided, it is possible to attain the object by the pressure medium 114.

The outer casing container 112 may be made entirely of a restorable elastic material, or as shown in FIG. 2 and FIG. 3, it may partly include a restorable press portion 122. That is, as shown in FIG. 2, the outer casing container 112 may be made of a hard material such as a hard plastic and its portion may be thinned to form the restorable press portions 122, or as shown in FIG. 3, a material different from the outer casing container 112 such as rubber and the like which is restorable may be used partly to form the press portions 122.

Figure 4:
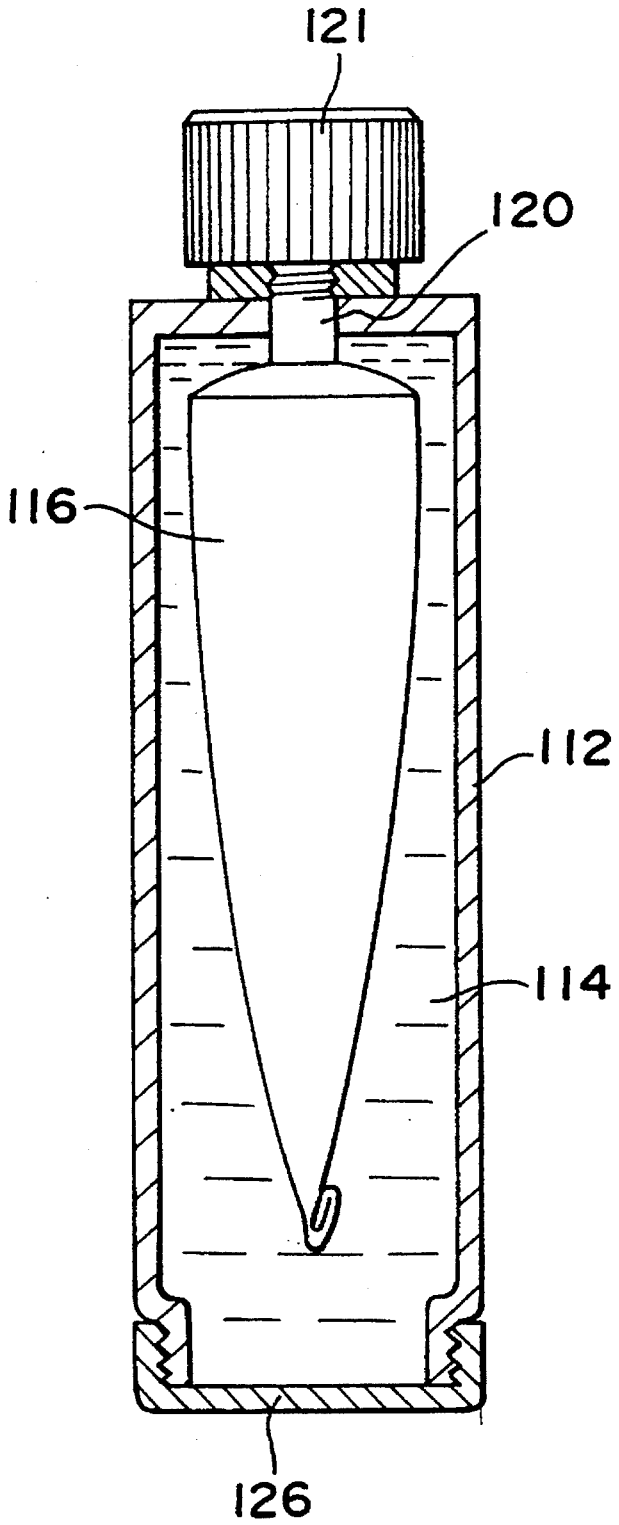
FIG. 4 is a schematic sectional view of a composite container showing an example of an outer casing container, whose closing cap is mounted on a bottom.

When the outer casing container 112 is formed into a bottle shape, the composite container 110 of the present invention can be placed vertically on a bottom 124, or as shown in FIG. 4, when a cap body 121 is formed planarly, it can be placed upside down on the cap body 121, in this case, it is suitable for the contents having some viscosity.

Depending on the pressure medium 114, it is sealed hermetically in the closed state by means of the cap 126 of the outer casing container 112. The closing cap 126 may be positioned at the bottom side of the outer casing container 112 as shown in FIG. 4, or may be formed integrally with the outer casing container 112.

An aluminum tube was used as the inner container 116. It is not restricted to the metal tubes, a laminated tube or a polyethylene may also be used. For example, when an oil liquid is used as the pressure medium 114, even when the contents is a moisture curing type adhesive, the plastic tube can be used because the moisture is interrupted by the oil liquid.

In the following, though the present invention is described by the embodiments, the present invention is not limited to these embodiments.

EMBODIMENT 1

To 100 g of Sumiphen 3900 (polyetherpolyol by Sumitomo Beyer Urethane Co.), 0.03% of dibutyl tin dilaurate (accelerator) was added and mixed.

Meanwhile, 12.6 g of Sumidur PF (polyisocyanate by Sumitomo Beyer Urethane Co.).was added and mixed to prepare liquid compositions. Viscosity of the liquid compositions was about 800 cps at 25°.

About 4.6 g of this liquid composition was poured into gaps of the outer casing container 112 (size: 24 mm diameter, 45 mm length) into which the inner container 116 (size: 12.9 mm diameter, 43 mm length) is set as shown in FIG. 1. The outer casing container 112 was covered by the closing cap 126, the pot-life was about 20 to 30 minutes, and after 12 to 24 hours, a restorable composite container containing a preferred restorable rubber-like elastic was obtained.

EMBODIMENT 2

To 145 g of Plakcel 230L (polycaprolactone group polyol by Daicel Chamical Co.), 0.03% of dibutyl tin dilaurate (accelerator) was added and mixed.

Meanwhile, 8.0 g of Sumidur 44V20 (polyisocyanate by Sumitomo Beyer Urethane Co.) was added and mixed to prepare liquid compositions. Viscosity of the liquid compositions was about 1700 cps at 25° C.

About 4.6 g of this liquid composition was poured into gaps of the outer casing container 112 (size: 24 mm diameter, 45 mm length) into which the inner container 116 (size: 12.9 mm diameter, 43 mm length) is set as shown in FIG. 1. The outer casing container 112 was covered by the closing cap 126, the pot-life was about 10 to 20 minutes, and after 12 to 24 hours, a restorable composite container having a good restoring force and containing a preferred rubber-like elastic was obtained.

EMBODIMENT 3

To 1054 g of Epol PW-90 (polyolefin group polyol by Idemitsu Petroleum Chemical Co.), 0.03% of dibutyl tin dilaurate (accelerator) was added and mixed.

Meanwhile, 142 g of Sumidur 44V20 (polyisocyanate by Sumitomo Beyer Urethane Co.) was added and mixed to prepare liquid compositions. Viscosity of the liquid compositions was about 6000 cps at 25° C.

About 4.6 g of this liquid composition was poured into gaps of the outer casing container 112 (size: 24 mm diameter, 45 mm length) into which the inner container 116 (size: 12.9 mm diameter, 43 mm length) is set as shown in FIG. 1. The outer casing container 112 was covered by the closing cap 126, the pot-life was about 2 to 3 minutes, and after 6 to 12 hours, a composite container having a good restoring force and containing a preferred rubber-like elastic was obtained.

EMBODIMENT 4

A main agent of Craft Resin (foamed urethane, registered trade name of Kokusai Chemical Co.) and a hardener were mixed quickly at 100:36 (by weight) to obtain a foamed material.

This foamed material was quickly poured into gaps of the outer casing container 112 (size: 40 mm diameter, 60 mm length) into which the inner container 116 (size: 20 mm diameter, 50 mm length) is set as shown in FIG. 1. In this case, the outer casing container 112 was not covered by the cap 126, the pot-life was about several tens of seconds, and after about 5 minutes, a composite container having a good restoring force and containing a preferred rubber-like elastic was obtained.

EMBODIMENT 5

A sheet foamed urethane foam which is commercially available was chopped into pieces of about 2 mm diameter to obtain rubber elastic. This rubber elastic was filled tightly in gaps of the outer casing container 112 (size: 45 mm diameter, 55 mm length) into which the inner container 116 (size: 30 mm diameter, 50 mm length) is set as shown in FIG. 1. In this case, the outer casing container 112 was covered by the cap 126 into a closed state to obtain a composite container having an adequate restoring force.

EMBODIMENT 6

A chipped urethane rubber which is commercially available is chopped into pieces of about 2 mm diameter to obtain rubber-like elastic. This rubber-like elastic is filled in the outer casing container 112 in the same manner as in the Embodiment 5 to obtain a composite container having an adequate restoring force.

EMBODIMENT 7

The inner container 116 (size: 12.0 mm diameter, 40 mm legnth) was set in the outer casing container 112 (size: a cylinder of 24 mm diameter and 60 mm length) having the press portions 122 as shown in FIG. 2, and water was filled in the gaps in a completely closed state as a pressure medium. The closed state was obtained by covering the cap or by fused sealing.

Thereafter, when pressing the press portions 122, a restorability was obtained without dripping of liquids, and the effects of the present invention were accomplished.

EMBODIMENT 8

The inner container 116 (size: 12.0 mm diameter, 40 mm length) was set in the outer container 112 (size: a cylinder of 24 mm diameter and 60 mm length) having the press portion 122 as shown in FIG. 3, and a silicon oil was filled in the gaps in a completely closed state as the pressure medium 114. The closed state was obtained by covering the cap or by fused sealing.

Thereafter, the press portions 122 were pressed to obtain a restorability without dripping of liquids, and the effects of the present invention were accomplished.

Second Invention (Forming the Latchet Teech), Third Invention (Forming of Positioning Groove and Protrusions) and Fourth Invention (Forming of Ribs for Preventing Dripping of Liquids)

The present invention is particularly described in the following based on a specific embodiment shown in the accompanying drawings.

Figure 8:
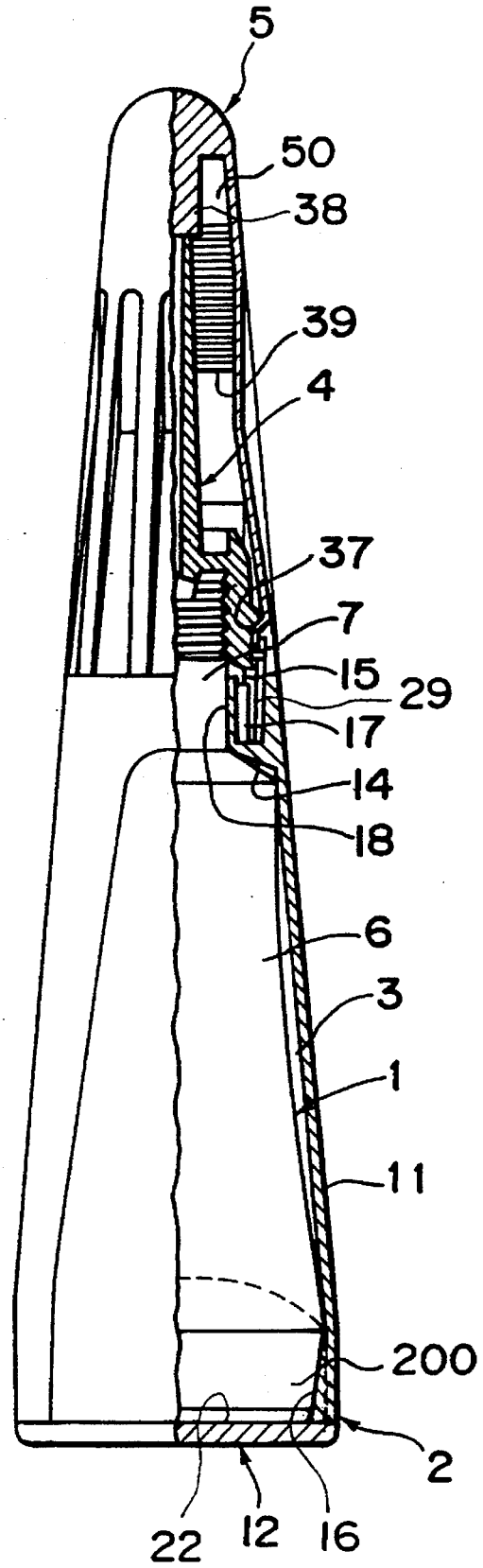
FIG. 8 is a semi-sectional front view of a composite container showing a preferred embodying mode of the present invention.

FIG. 8 is a semi-sectional front view of a composite container showing a preferred embodying mode of the present invention, and comprising an inner container 1, an outer casing container 2, a pressure medium 3, a nozzle 4 and a cap 5.

Figure 9:
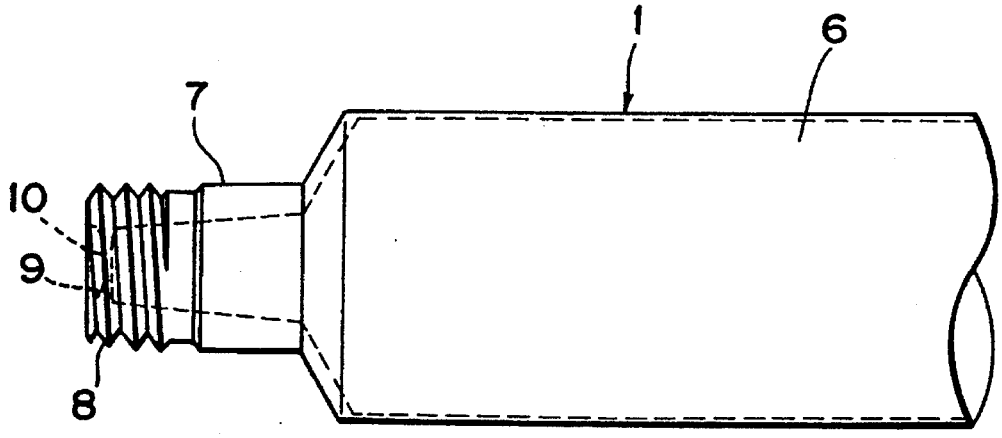
FIG. 9 is a front view of an inner container of FIG. 8 of the present invention.

As shown in a semi-sectional front view of FIG. 8, the inner container 1 includes a body 6 containing the contents and an opening 7 for discharging the contents from the body 6 as shown in a front view of FIG. 9, and is formed with a material which is inactive against the contents and has no permeability.

For example, as the material constituting the inner container 1 which contains instantaneous adhesives such as α-cyanoacrylate, for example, metals such as aluminum, lead and the like which are suitable for containing the moisture hardening type or solvent volatile type contents, or materials composed by laminating these metals and synthetic resins are used.

On the outer end surface of the opening 7 of the inner container 1, a thread 8, whereon the nozzle 4 is screwed, is formed, and a mouth 9 formed at a tip portion of the opening 7 is closed by a thin film 10, which is to be broken by a piercing protrusion 25 of the nozzle 4, before use. A bottom is closed by a fold-back portion 200 after filling the contents.

The shape of the outer casing container 2 is not, particularly, restricted as far as it can preferably hold the pressure medium 3 around the inner container 1. For example, any shapes such as an equal diameter or different diameter tube, box, nut and guitar having a sectional shape of, for example, cylinder, ellipse and polygons such as a triangle, quadrangle and the like may be formed.

Figure 10:
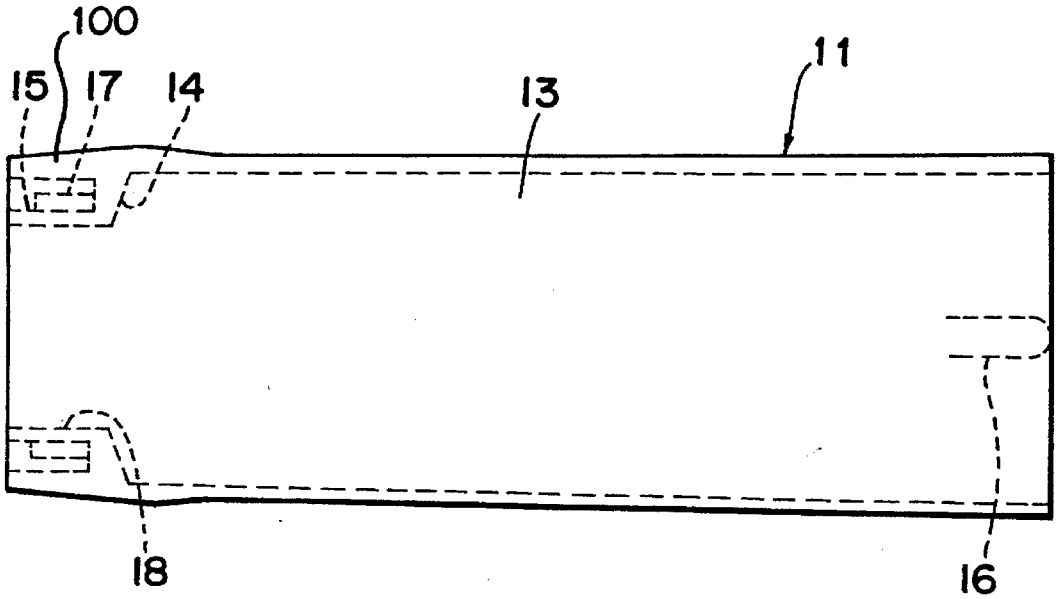
FIG. 10 is a side view of a main member of an outer casing container of FIG. 8 of the present invention.
Figure 11:
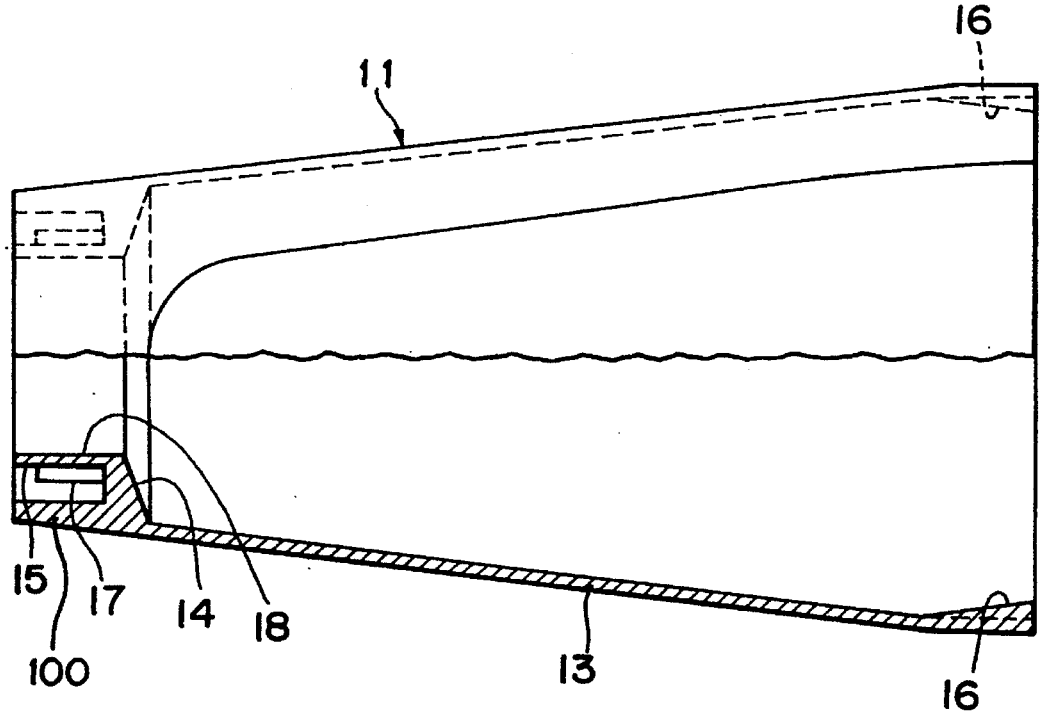
FIG. 11 is a semi-sectional front view of a main member of an outer casing container of FIG. 8 of the present invention.
Figure 12:
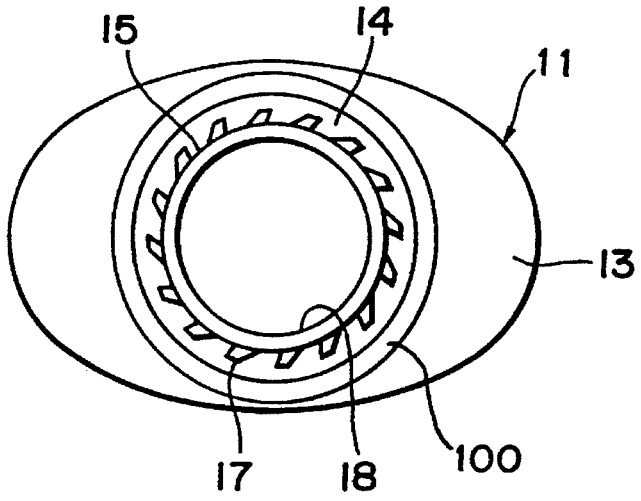
FIG. 12 is a plan view of a main member of an outer casing container of FIG. 8 of the present invention.

In this embodiment, as shown in a side view of FIG. 10, a semi-sectional front view of FIG. 11 and a plan view of FIG. 12, in order to improve the handiness and external appearance, the external shape of the outer casing container 2 is formed into a gently tapered cylindrical shape at the top. The front and rear faces are scraped off planarly toward the upper end portion to form an elliptic tube at the bottom. Also, in this embodiment, in order to place the composite container upward, the bottom face of the outer casing container 2 is formed planarly.

Though the outer casing container 2 may be formed integrally, in this embodiment, as shown in FIG. 8, it is divided into a main member 11 and a bottom member 12. The main member 11 is formed with a synthetic resin which is easily deformed elastically by a biasing force from the outside. Examples of this kind of synthetic resins include polyethylene, polypropylene, polyester, polyamide, polyvinyl chloride, polybutadiene and the like, and among which, particularly, polybutadiene having a good restoring force is recommendable.

As shown in FIG. 11, the main member 11 includes an outer wall 13, a shoulder wall 14, a boss 15 formed with latchet teeth 17 around the outer surface thereof and positioning protrusions 16, wherein the outer wall 13 surrounds, the entire body 6 of the inner container 1 and a base end portion of the opening 7, and further, it is extended to cover the boss 15 to form a protective cover 100 and to improve the external appearance. The shoulder wall 14 is formed toward the inner upper portion of the outer wall 13, and the boss 15 is formed continuously on the inner upper surface of the shoulder wall 14. Moreover, as shown in FIG. 12, the latchet teeth 17 are formed on the outer surface of the boss 15.

The positioning protrusions 16 are protruded inward at two locations opposing each other on a longitudinal axis of the bottom inner surface of the main member 11. Though the shape of the positioning protrusions 16 are not, particularly, restricted, hereupon, as shown in FIG. 11, the protrusion is gradually reduced upward from the bottom of the main member 11, and is formed into the shape continued smoothly to the bottom inner surface of the main member 11 at the upper end.

As shown in FIG. 8, in this embodiment, the inner container 1 is inserted from the opening 7 side through the bottom of the outer casing container 2, and after inserting the opening 7 into an inserting hole 18 extended through the shoulder wall 14 and the boss 15, the pressure medium 3 is filled between the inner container 1 and the outer casing container 2, and furthermore, the bottom member 12 is inserted into the bottom of the main member 11.

The pressure medium 3 may be liquids or elastics or intermediate viscoelastic substances as far as it can transfer the biasing force applied to the outer casing container 2 to the inner container 1, and deform in response to deformations of the inner container 1 and the outer casing container 2.

Also, in the present invention, in order to enhance the pressure transferring efficiency, it is advantageous to use the material having a tackiness or an adhesiveness against one or both of the inner container 1 and the outer casing container 2 as the pressure medium 3.

As liquids composing the pressure medium 3, low viscosity liquids such as water, oil and the like and high viscosity liquids such as polyethylene glycol, silicon oil, paraffin, liquid rubbers (liquid B, liquid SBR, liquid NBR, etc.), liquid polybutadiene, liquid polychloroprene, liquid polysulfide, liquid polyisoprene, liquid butyl rubber and the like are given as example.

Examples of the viscoelastic substances used includes, a solid colloid or a so-called gel, gelatin, low molecular weight polyethylene, paste and the like.

Examples of the elastics used, include formed materials, sealing agents, rubber elastics, elastic synthetic resins, elastic adhesives and the like.

Examples of the thin kind of foamed materials used, include), urethane foam, foamed polystyrene, foamed polyethylene, foamed plypropylene.

As for the sealing agents, single-liquid silicon, single-liquid urethane and the like are given as the examples.

Furthermore, as the rubber elastics, natural rubbers and synthetic rubbers are included, and in the synthetic rubbers, besides the BR, SBR, NBR, IR, EPDM etc., urethane rubber, silicon rubber, acrylic rubber, ethylene acrylic rubber, polyether group rubbers, propylene oxide rubber and various elastomers are included.

Hereupon examples of the various elastomers include, styrene group thermoplastic elastomer, olefin group thermoplastic elastomer, urethane group thermoplastic elastomer, polyester group thermoplastic elastomer, polyamide group thermoplastic elastomer, polybutadiene group thermoplastic elastomer, vinyl chloride group thermoplastic elastomer, fluorine group thermoplastic elastomer and the like.

As the elastic synthetic resins, thermoplastic resins such as polyethylene, polypropylene, polyvinyl chloride, polystyrene, polyvinylidene chloride, fluorine resin, polymethyl methacylate, polyamide such as nylon, polyester, polycarbonate, polyphenylene oxide, polyurethane, polyacetal and the like are given, and as the elastic adhesives, hot melt adhesives such as ethylene-vinyl acetate group (EVA group) hot melt adhesives, thermoplastic rubber group hot melt adhesives, polyamide group hot melt adhesives, polyester group hot melt adhesives, head hardening hot melt adhesives and the like are given as the example.

In this embodiment, the rubber elastics are adopted among these materials. The reason is that, the pressure medium 3 composed of the rubber elastics can be filled tightly, without gaps, between the inner container 1 and the outer casing container 2, by hardening the single-liquid type or double-liquid type liquid compositions which is a precursor, after pouring it between the inner container 1 and the outer casing container 2 and closing the bottom opening of the main member 11 with the bottom member 12. Thus, not only the manufacturing process is simplified, it is also advantageous in that the pressure medium 3 can be stuck to the inner container 1 and the outer casing container 2 to enhance the pressure transferring capability.

Though the material of the bottom member 12 is not, particularly, restricted, the materials having the tackiness and adhesiveness against the pressure medium 3 are preferably used, and for example, the heat hardening resins such as polystyrene, orefin group resins, urethane resin, polyester, polyamide, polybutadiene, polyvinyl chloride, fluorine resin and the like are used.

Figure 13:
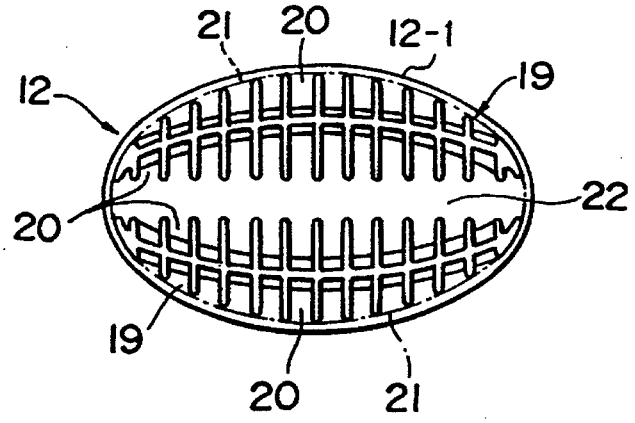
FIG. 13 is a plan view of a bottom member of an outer casing container of FIG. 8 of the present invention.
Figure 14:
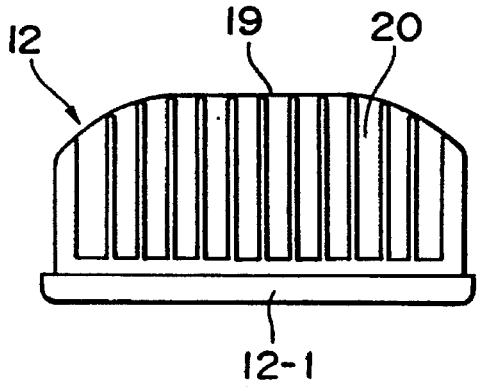
FIG. 14 is a front view of a bottom member of an outer casing container of FIG. 8 of the present invention.
Figure 15:
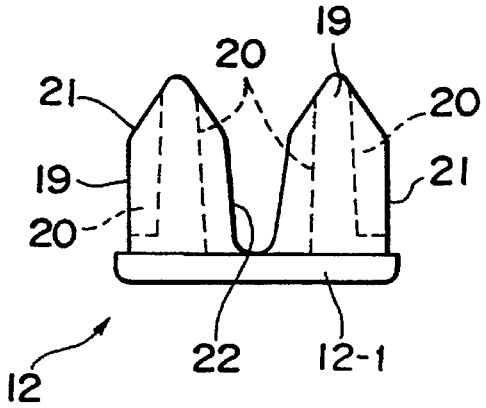
FIG. 15 is a side view of a bottom member of an outer casing container of FIG. 8 of the present invention.

As shown in a plan view of FIG. 13, a front view of FIG. 14 and a side view of FIG. 15, the bottom member 12 includes an elliptic bottom wall 12-1 and a pair of spacers 19 raised from the bottom wall 12-1 at linearly symmetrical locations with respect to a longitudinal axis of the bottom wall 12-1. Outer envelope surfaces 21 of the spacers 19 are inscribed to the inner surface of the main member 11, and a positioning groove 22, into which the bottom of the inner container 1 and the positioning protrusions 16 are inserted, is formed between the spacers 19.

The positioning groove 22 is formed into a V shape which is gradually inclined on the top end (upper end) side and steeply inclined on the base end side, and when inserting the bottom member 12 into the main member 11, the positioning protrusions 16 are guided along the side faces of the positioning groove 22 and fixed therebetween to position the bottom member 12 so that an axial direction of the bottom member 12 coincides with an axial direction of the main member 11, while the bottom of the inner container 1 inserted into the main member 11 is fit into the positioning groove 22 and positioned between the positioning protrusions 16. Thereby, the fold-back portion (designated by numeral 200 in FIG. 8) of the inner container 1, into which the contents is filled, is fixed securely to the center portion of the outer casing container 2 to enhance the pressure transferring capability.

Though the surface of the spacers 19 may be formed into a smooth face evenly, in this embodiment, in order to enlarge the tacky area or the adhesive area with the pressure medium 3, it is formed into an uneven face having a number of concave grooves 20.

In this embodiment, since the inner side face of the positioning protrusions 16 is formed so as to continue smoothly to the inner surface of the outer wall 13 at the upper end, when the bottom fold-back portion 200 of the inner container 1 is guided by the spacers 19 from the direction different from the axial direction of the main member 11 and positioned between the positioning protrusions 16 as rotating, the bottom fold-back portion 200 of the inner container 1 can be smoothly mounted on the positioning protrusions 16 substantially without resistance, enhancing the assembling operability.

Also, in this embodiment, since the upper portion of the outer envelope face 21 of the spacers 19 is inclined inward to facilitate insertion of the bottom member 12 into the main member 11, the assembling operability of the outer casing container 2 is more enhanced.

When the bottom member 12 is engaged to the bottom opening of the main member 11, the bottom of which is received by the spacers 19 of the bottom member 12 and kept in shape. Thus, a restorability of the main member 11 can be improved without hardening the main member 11, and by using the soft main member 11 the contents can be squeezed out with a weak force, improving the handiness.

Since the outer casing container 2 can be assembled by just engaging the bottom member 12 with the bottom of the main member 11, the assembling operability is enhanced as compared with the case where the bottom member 12 is screwed into the bottom of the main member 11.

Furthermore, since the outer casing container 2 can be assembled by engaging the bottom member 12 into the bottom opening of the main member 11, a bottom sectional shape of the main member 11 can be formed into any shapes other than the cylindrical shape, and for example, it can be formed into an elliptic shape as this embodiment to improve external appearance.

Figure 16:
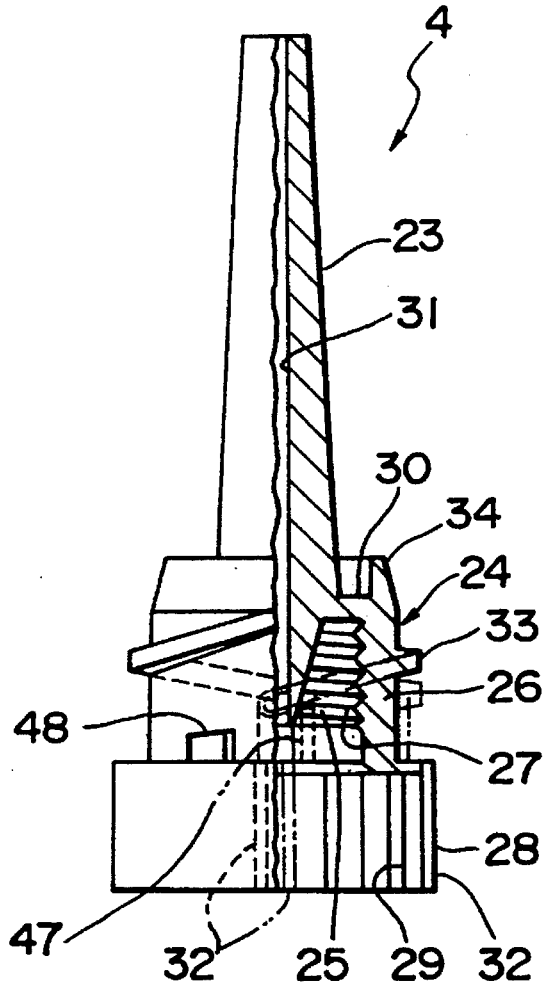
FIG. 16 is a semi-sectional front view of a nozzle of FIG. 8 of the present invention.
Figure 17:
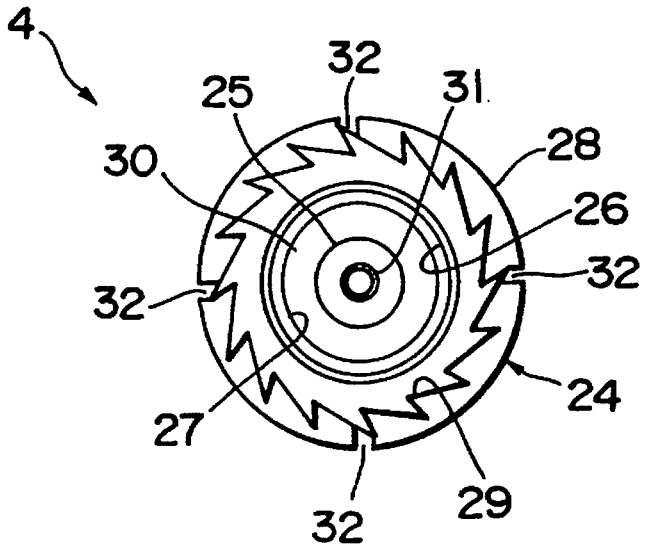
FIG. 17 is a bottom view of a nozzle of FIG. 8 of the present invention.

As shown in a semi-sectional front view of FIG. 16 and a bottom view of FIG. 17, the nozzle 4 includes a nozzle body 23, a connection 24 and a piercing protrusion 25, wherein the lower side of the connection 24 is formed into a large diameter stepped cylindrical shape, an internal thread 27 corresponding to a thread 8 formed on the opening 7 of the inner container 1 is formed on the inner surface of a reduced diameter portion 26, and inner latched teeth 29 corresponding to the latched teeth 17 of the outer casing container 2 are formed on the inner surface of the large diameter portion 28.

The nozzle body 23 is protruded upward from an upper end wall 30 of the reduced diameter portion 26, and its outer surface is tapered gradually toward the end. The piercing protrusion 25 is protruded downward from the upper end wall 30 of the reduced diameter portion 26, and its outer surface is tapered toward the end. A right circular-hole discharge path 31 is extended from the lower end of the piercing protrusion 25 to the upper end of the nozzle body 23.

On an outer wall of the large diameter portion 28, slits 32 which are cut from the outer surface to the inner surface of the large diameter portion 28 throughout the entire height of the large diameter portion 28 are formed at four locations suitably spaced from each other circumferentially.

On an outer surface of the reduced diameter portion 26, threads 33 for screwing the cap 5 thereon are formed, and at either of the two threads 33, engage pieces 47 which engage with thread-end groove 46 of a screw 37 of the cap 5, to be described later, are protruded between the large diameter portion 28 toward the lower end, and a stop piece 48 for preventing overscrewing of the cap 5 onto the nozzle 4 is protruded slightly apart from the end of the threads 33. Entirely around the-upper end wall 30, a liquid stopper 34 for preventing effluents, which has dropped along the outer surface of the nozzle body 23, from dripping along the outer surface of the reduced diameter portion 26 is protruded upward.

Figure 18:
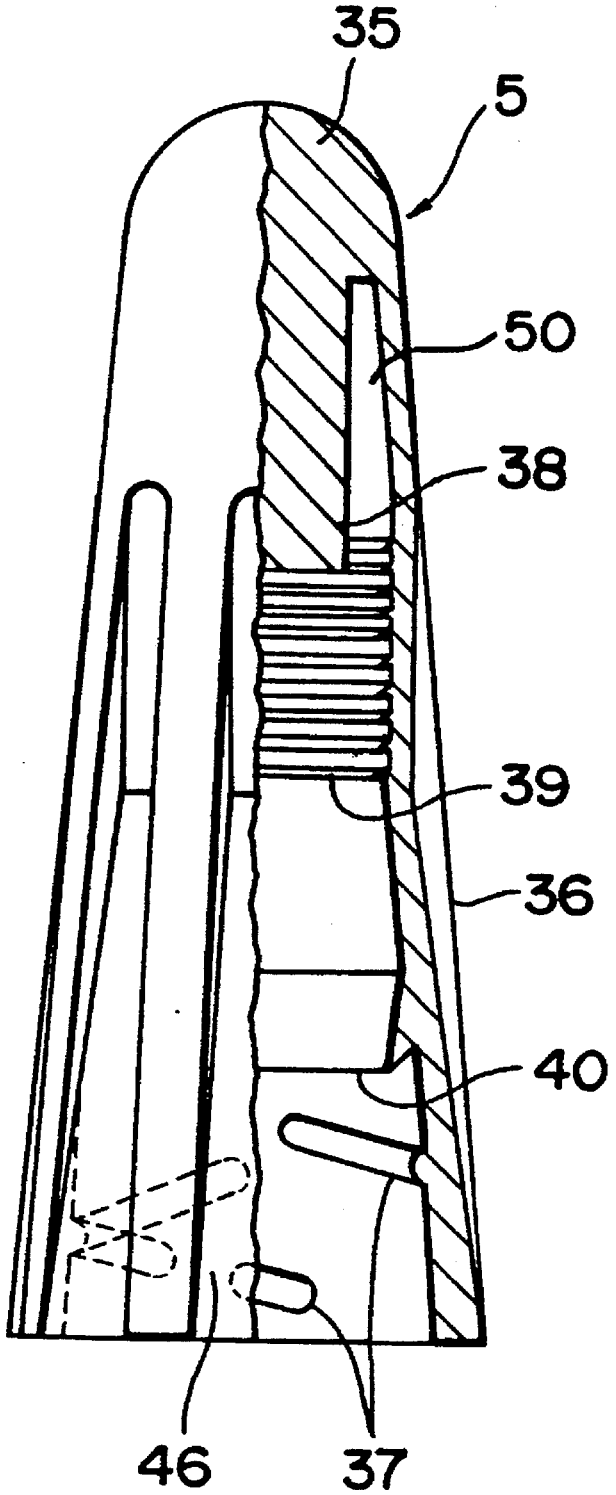
FIG. 18 is a semi-sectional front view of a cap of FIG. 8 of the present invention.

As shown in a semi-front view of FIG. 18, the cap 5 includes a semi-spherical head portion 35 and a skirt portion 36 which is tapered upward and continued to the edge portion thereof, and the threads 37 corresponding to the thread 33 of the nozzle 4 are formed around the lower inner surface of the skirt portion 36. The thread end groove 46, which receives the engage piece 47 of the nozzle 4, is provided toward lower ends of the two threads 37, and is engaged with the engage piece 47 to keep the cap 5 from loosening easily, and to prevent the effluents from dripping down from between the seal portion 38 of the cap 5 and the discharge path 31 opening. Under the semi-spherical head porion 35, the seal portion 38, which contacts to the upper end of the nozzle 4 in the skirt portion 36 when the cap 5 is screwed onto the nozzle 4 sufficiently and closes the discharge path 31, is formed.

Figure 19:
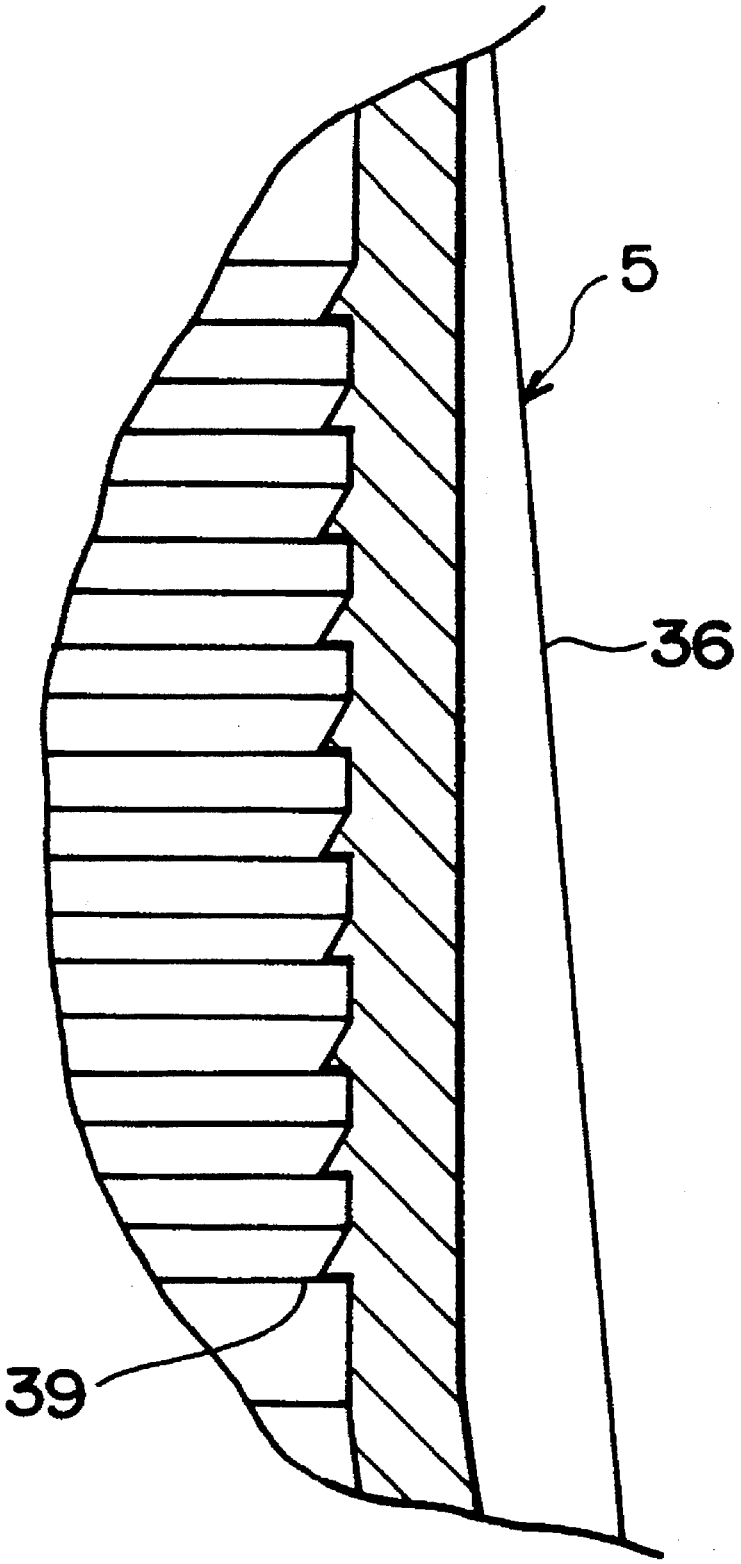
FIG. 19 is an enlarged sectional view of essential portions of a cap of FIG. 8 of the present invention.

On the inner surface of the cap 5 between the seal portion 38 and the threads 37, ribs 39 for preventing dripping of liquids are formed up to the seal portion 38 in a vertical multistage. A sectional shape of the ribs 39 is, as shown in an enlarged sectional view of FIG. 19, formed into a right triangle or an acute triangle whose lower face is descending inward, so that the effluents, which sticks to the inner surface of the cap 5 and tends to flow down, is accumulated in the inner edges of the ribs 39 in drops.

On the inner surface of the cap 5, a restrict portion 40, which is received by the outer surface of the liquid stopper 34 of the nozzle 4, when the cap 5 is screwed onto the nozzle 4 till a predetermined depth, is formed.

When the cap 5 is mated with the nozzle 4 and screwed on till a predetermined depth, the restrict portion 40 is received by the outer surface of the liquid stopper 34 of the nozzle 4 to restrict screwing of the cap 5 onto the nozzle 4. When the internal thread 27 of the nozzle 4 is mated with the thread 8 formed on the opening 7 of the inner container 1 and screwed on, while the cap 5 is screwed onto the nozzle 4 till the predetermined depth in such a manner, the piercing protrusion 25 of the nozzle 4 advances into the mouth 9 of the inner container 1 and breaks through the thin film 10, thereby the inner portion of the inner container 1 communicates with the discharge path 31 of the nozzle 4, and the piercing portion 25 of the nozzle 4 is received by the opening 7 of the inner container 1 and screwing of the nozzle 4 onto the inner container 1 is restricted, and at the same time, between the nozzle 4 and the opening 7 of the inner container 1 is sealed.

When the cap 5 is screwed on further, the inner latched teeth 29 contact to the latched teeth 17 and are pushed out in an outer circumferential direction. When the large diameter portion 28 of the nozzle 4 is continued circumferentially, though the inner latched teeth 29 can not be pushed out in the outer circumferential direction unless the large diameter portion 28 is not extended circumferentially against the elasticity of the large diameter portion 28 of the nozzle 4, in this embodiment, since the slits 32 which are cut from the outer surface to the inner surface throughout the entire height of the large diameter portion 28 are formed, the large diameter portion 28 can be diametrically expanded easily and the inner latched teeth 29 can be pushed out in the outer circumferential direction. Thus, by screwing the cap 5 with a relatively weak force above a fixed force, the inner latched teeth 29 is pushed out in the outer circumferential direction over the latched teeth 17, thereby the nozzle 4 and the cap 5 rotate idly against the outer casing container 2, and the cap 5 is prevented from being screwed onto the nozzle 4 above a fixed force.

Thereafter, when the cap 5 is rotated counterclockwise, since the inner latched teeth 29 are engaged with the latched teeth 17, nozzle 4 can not rotate counterclockwise against the outer casing container 2, thus the nozzle 4 is reliably prevented from rotating together with the cap 5 and being unscrewed from the inner container 1, and only the cap 5 can be removed surely.

When the outer wall 13 of the outer casing container 2 is clamped and pressed by the fingers while the cap 5 is removed, the outer wall 13 of the outer casing container 2 is collapsed and the biasing force is transferred to the body 6 of the inner container 1 via the pressure medium 3 and the inner container 1 is collapsed, thereby the contents is discharged to the out side through the discharge path 31 of the nozzle 4.

Though a portion of effluents is stuck to the end portion of the nozzle body 23, when force pressing the outer casing container 2 is removed, the outer casing container 2 and the pressure medium 3 are restored elastically, thereby, the shape of the inner container 1 is restored and the effluents stuck to the end portion of the nozzle body 23 is mostly sucked back into the discharge path 31 or the inner container 1, thereby the dripping of liquids hardly occurs.

By some reasons, the effluents stuck to the outer surface of the end portion of the nozzle body 23 is hardly sucked back into the discharge path 31 or the inner container 1, and sometimes it drops onto the connection 24 along the outer surface of the nozzle body 23. However, the effluents dripped onto the connection 24 is accumulated in an annular space formed between the base end portion of the nozzle body 23 and the liquid stopper 34, and never drops onto the outer surface of the connection 23. Thereby, it is possible to reliably prevent the effluents from sticking to the thread 33 of the nozzle 4 to hinder screwing of the cap 5 onto the nozzle 4, and the nozzle 4 and the cap 5 screwed thereon from sticking one another, results in enhancing the screwing operability of the cap 5.

When the cap 5 is screwed on after use, though the end portion of the nozzle body 23 contacts to the inner surface of the cap 5 and the effluents sticks slightly to the inner surface of the cap 5 from the end portion of the nozzle body 23, the effluents, which is stuck to the inner surface of the cap 5 and tends to drip along the inner surface of the cap 5, is caught by the ribs 39 for preventing the dripping of liquids and never drops to the thread 37. Thus, it is possible to reliably prevent the effluents from sticking to and solidifying on the thread 37 of the cap 5 to hinder screwing of the cap 5, or sticking the nozzle 4 and the cap 5 screwed thereon, results in enhancing the screwing operability of the cap 5.

When the cap 5 is screwed on after use, though the end portion of the nozzle body 23 contacts to the inner surface of the cap 5 and the effuluents sticks slightly to the inner surface of the cap 5 from the end portion of the nozzle body 23, the effluents, which is stuck to the inner surface of the cap 5 and tends to drip along the inner surface of the cap 5, is caught by the ribs 39 for preventing the dripping of liquids and never drops to the thread 37. Thus, it is possible to reliably prevent the effluents from sticking to and solidifying on the thread 37 of the cap 5 to hinder screwing of the cap 5, or sticking the nozzle 4 and the cap 5 screwed thereon, results in enhancing the screwing operability of the cap 5.

Figure 20:
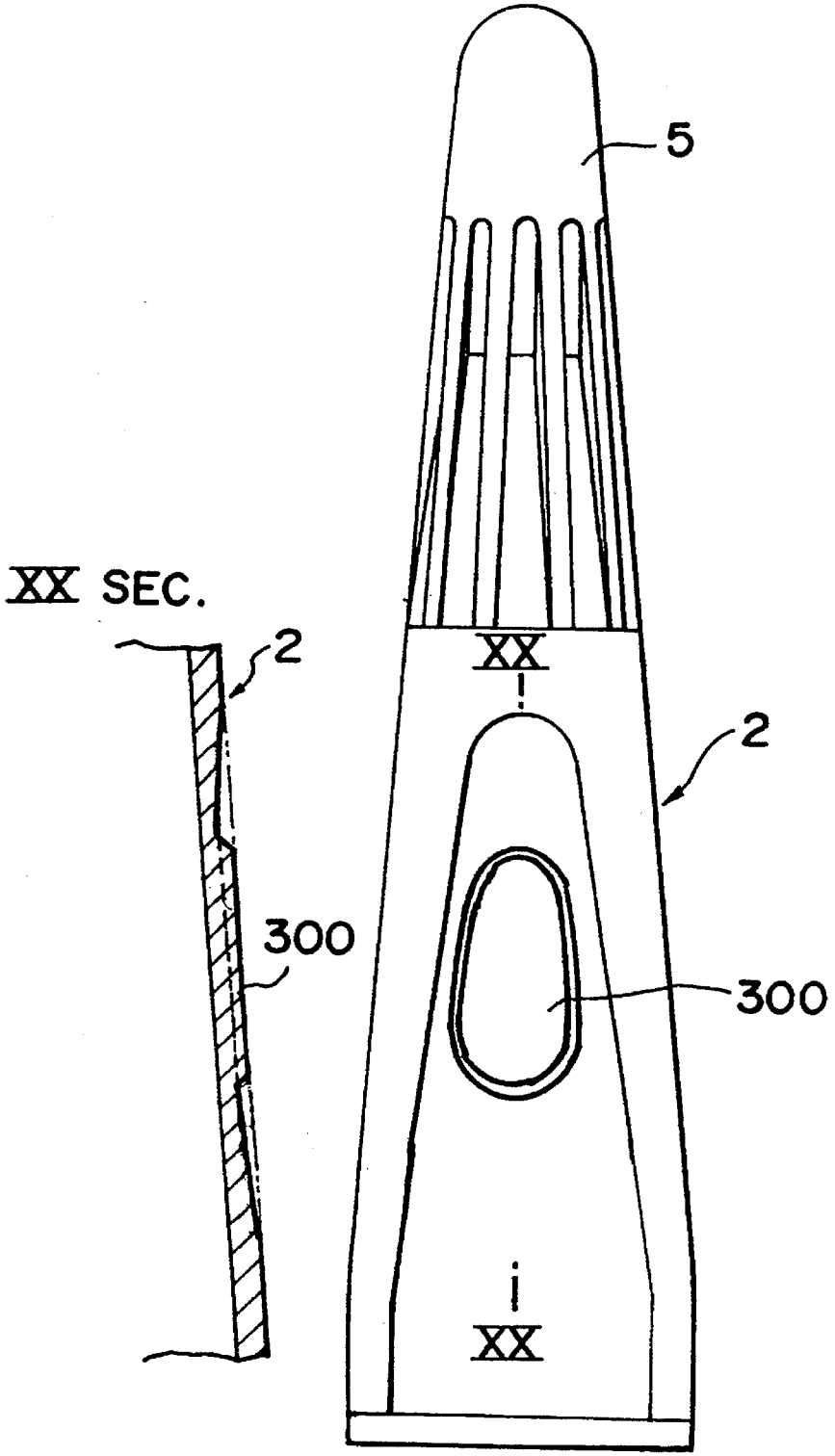
FIG. 20 is front and sectional two-plane views of an outer casing container provided with a press portion of FIG. 8 of the present invention.

Also, as shown in FIG. 20, by forming a flat protruded press portion 300 whose periphery is depressed, on the side face of the outer casing container 2, which is pressed easily and also the external appearance can be improved.

What is claimed is:

1. A composite container for low viscosity liquids comprising;

an inner container having a deformable body formed of a metal tube without self-restoring properties for housing liquid and an opening through which the liquid is discharged from the body;

a deformable outer casing container which covers the body of said inner container and is restorable when released from an applied force; and a pressure medium formed of an elastic material interposed between said inner container and aid outer casing container;

wherein the body of the inner container is capable of being pressurized through the pressure medium by a force applied against said outer casing container to cause the liquid to be discharged, and the outer casing container is restored by the releasing of the force applied against said outer casing container to cause the pressure inside of the outer casing container to be reduced, whereby following the pressure reduction in said outer casing container the pressure on the body of the inner container is also reduced and thus air is introduced into the body of the inner container to cause the shape of the body of the inner container to be reset to an original shape.

2. A composite container for liquids in accordance with claim 1, wherein said pressure medium is an elastic solid material.

3. A composite container for liquids in accordance with claim 2, wherein said elastic solid material is a rubber elastic material.

4. A composite container for liquids in accordance with claim 3, wherein said rubber elastic material is a urethane resin elastomer.

5. A composite container for liquids in accordance with claim 1, wherein said pressure medium is interposed between said inner container and said outer casing container and completely fills a space therebetween.

6. A composite container for liquids in accordance with claim 1, wherein said inner container is a metal tube.

7. A composite container for liquids in accordance with claim 6, wherein said metal tube is an aluminum tube.

8. A composite container for liquids in accordance with claim 1, wherein said outer casing container is formed of an elastic resin.

9. A composite container for liquids in accordance with claim 8, wherein said elastic resin is polybutadiene.

10. A composite container for liquids in accordance with claim 1, wherein a press portion is provided on said outer casing container.

11. A composite container for liquids comprising:

an inner container which contains a liquid and includes an inner container body and an opening;

an outer casing container which covers said inner container body, a nozzle having a discharge path and being screwed onto the opening of the inner container; and a cap which closes the discharge path of the nozzle and is screwed onto the nozzle;

said composite container being characterized, in that a pressure medium is sealed between the inner container body and the outer casing container, in that a boss is provided on a top of said outer casing container and a portion of the opening of the inner container is inserted into said boss of the outer casing container and outer latched teeth are formed on an outer surface of said boss, and in that inner latched teeth which mate with the outer latched teeth are provided on the nozzle.

12. A composite container for liquids in accordance with claim 11, wherein at a portion of said nozzle where said inner latched teeth are formed, slits are provided which divide the portion circumferentially.

13. A composite container for liquids in accordance with claim 11, wherein said pressure medium is formed of an elastic material.

14. A composite container for liquids characterized, in that an outer casing container covers an inner container body containing a liquid and includes a tubular main member and a bottom member disposed in a bottom opening of the tubular main member, in that a pressure medium is interposed between the inner container body and the outer casing container, in that a bottom wall which closes the bottom opening of the tubular main member and spacers which are raised from the bottom wall and inserted into the bottom opening of the tubular main member are provided on the bottom member, in that a positioning groove into which an inner container body bottom is inserted for positioning is formed in the center of the spacers, and in that positioning protrusions which advance into the positioning groove for positioning protrude from the tubular main member.

15. A composite container for liquids in accordance with claim 14, wherein an upper portion of said spacers is inclined.

16. A composite container for liquids in accordance with claim 14, wherein a number of concave grooves are provided on a surface of said spacers.

17. A composite container for low viscosity liquids, comprising, an inner container which contains a liquid and includes an inner container body formed of a metal tube without self-restoring properties and an opening, an outer casing container covering the inner container body, a nozzle having a discharge path and mounted on the opening of the inner container, and a cap for screwing onto the nozzle, wherein a pressure medium is sealed between the inner container body and the outer casing container, and wherein ribs for preventing dripping of liquid are formed on an inner surface of a portion above a mounting portion of the cap.

18. A composite container for liquids in accordance with claim 17, wherein said cap is screwed onto a base of the nozzle to close the discharge path of the nozzle.

19. A composite container for liquids in accordance with claim 17, wherein said nozzle is screwed onto the opening of said inner container.

20. A composite container for liquids in accordance with claim 17, wherein at least two of said ribs for preventing dripping of liquids are formed in an inwardly descending inclined face of the inner surface of the cap.

21. A composite container for liquids in accordance with claim 20, wherein at least two of said ribs for preventing dripping of liquids are formed in multiple vertical stages.

22. A composite container for liquids in accordance with claim 17, wherein a protruded seal portion, which contacts an upper end of the nozzle and closes the discharge path of the nozzle when the cap is screwed onto the nozzle, is formed on a lower face in a head portion of the cap.

23. A composite container for liquids in accordance with claim 17, wherein said pressure medium is formed of an elastic material.

* * * * *